US007710326B2

(12) United States Patent
Lee

(10) Patent No.: US 7,710,326 B2
(45) Date of Patent: May 4, 2010

(54) ANTENNA CLUSTERS FOR ACTIVE DEVICE REDUCTION IN PHASED ARRAYS WITH RESTRICTED SCAN

(75) Inventor: Gregory S. Lee, Mountain View, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 824 days.

(21) Appl. No.: 11/551,443

(22) Filed: Oct. 20, 2006

(65) Prior Publication Data

US 2008/0094296 A1 Apr. 24, 2008

(51) Int. Cl.
*H01Q 1/38* (2006.01)

(52) U.S. Cl. ..... 343/700 MS; 343/840

(58) Field of Classification Search ..... 343/700 MS, 343/840, 810, 853, 893
See application file for complete search history.

(56) References Cited

U.S. PATENT DOCUMENTS 3,965,475 A * 6/1976 Deerkoski et al. ..... 342/374
4,291,311 A * 9/1981 Kaloi ..... 343/700 MS
5,450,090 A * 9/1995 Gels et al. ..... 343/700 MS
6,081,234 A * 6/2000 Huang et al. ..... 343/700 MS
6,384,787 B1 * 5/2002 Kim et al. ..... 343/700 MS
2004/0008149 A1 * 1/2004 Killen et al. ..... 343/795
2004/0201526 A1 * 10/2004 Knowles et al. ..... 343/700 MS

OTHER PUBLICATIONS http://www.crlopto.com/technology.html, Forth Dimension Displays, Technology, printed Oct. 5, 2006, 4 pp.

http://www.crlopto.com/SXGA-R2D.pdf, Forth Dimension Displays Ltd., printed Oct. 5, 2006, 2 pp.

* cited by examiner

*Primary Examiner*—HoangAnh T Le

(57) ABSTRACT

A plurality of antenna clusters form an antenna array used in microwave imaging. Each antenna cluster has at least two antenna elements and an active device. The active device controls the two antenna elements to direct microwave radiation to and from an object to capture a microwave image of the object.

16 Claims, 3 Drawing Sheets

Broadside E cluster

Off-axis E cluster

Broadside H cluster

Off-axis H cluster

Off-axis H cluster

ANTENNA CLUSTERS FOR ACTIVE DEVICE REDUCTION IN PHASED ARRAYS WITH RESTRICTED SCAN

CROSS-REFERENCE TO RELATED APPLICATIONS

This application is related by subject matter to U.S. Application for patent Ser. No. 10/997,422, entitled "A Device for Reflecting Electromagnetic Radiation," U.S. Application for patent Ser. No. 10/997,583, entitled "Broadband Binary Phased Antenna," both of which were filed on Nov. 24, 2004, and U.S. Pat. No. 6,965,340, entitled "System and Method for Security Inspection Using Microwave Imaging," which issued on Nov. 15, 2005.

This application is further related by subject matter to U.S. Application for patent Ser. No. 11/088,536, entitled "System and Method for Efficient, High-Resolution Microwave Imaging Using Complementary Transmit and Receive Beam Patterns," U.S. Application for patent Ser. No. 11/088,831, entitled "System and Method for Inspecting Transportable Items Using Microwave Imaging," U.S. Application for patent Ser. No. 11/089,298, entitled "System and Method for Pattern Design in Microwave Programmable Arrays," U.S. Application for patent Ser. No. 11/088,610, entitled "System and Method for Microwave Imaging Using an Interleaved Pattern in a Programmable Reflector Array," and U.S. Application for patent Ser. No. 11/088,830, entitled "System and Method for Minimizing Background Noise in a Microwave Image Using a Programmable Reflector Array" all of which were filed on Mar. 24, 2005.

This application is further related by subject matter to U.S. Application for patent Ser. No. 11/181,111, entitled "System and Method for Microwave Imaging with Suppressed Sidelobes Using Sparse Antenna Array," which was filed on Jul. 14, 2005, U.S. Application for patent Ser. No. 11/147,899, entitled "System and Method for Microwave Imaging Using Programmable Transmission Array," which was filed on Jun. 8, 2005 and U.S. Application for patent Ser. Nos. 11/303,581, entitled "Handheld Microwave Imaging Device" and 11/303,294, entitled "System and Method for Standoff Microwave Imaging," both of which were filed on Dec. 16, 2005.

This application is further related by subject matter to U.S. Application for patent Ser. No. 11/552,193, entitled "Convex Mount for Element Reduction in Phased Arrays with Restricted Scan" which was filed on Oct. 20, 2006, and U.S. Application for patent Ser. No. 11/551,382, entitled "Element Reduction in Phased Arrays with Cladding," which was filed on Oct. 20, 2006.

BACKGROUND OF THE INVENTION

Various microwave imaging systems have been proposed to satisfy the demand for improved security inspection systems, such as those used in airports to screen passengers and baggage. At present, there are several microwave imaging techniques available. For example, one technique uses an array of microwave detectors (hereinafter referred to as "antenna elements") to capture either passive microwave radiation emitted by a target associated with the person or other object or reflected microwave radiation reflected from the target in response to active microwave illumination of the target. A two-dimensional or three-dimensional image of the person or other object is constructed by scanning the array of antenna elements with respect to the target's position and/or adjusting the frequency (or wavelength) of the microwave radiation being transmitted or detected.

Microwave imaging systems typically include transmit, receive and/or reflect antenna arrays for transmitting, receiving and/or reflecting microwave radiation to/from the object. Microwave radiation is generally defined as electromagnetic radiation having wavelengths between radio waves and infrared waves. Such antenna arrays can be constructed using traditional analog phased arrays or binary reflector arrays. In either case, the antenna array typically directs a beam of microwave radiation containing a number of individual microwave rays towards a point or area/volume in 3D space corresponding to a voxel or a plurality of voxels in an image of the object, referred to herein as a target. This is accomplished by programming each of the antenna elements in the array with a respective phase shift that allows the antenna element to modify the phase of a respective one of the microwave rays. The phase shift of each antenna element is selected to cause all of the individual microwave rays from each of the antenna elements to arrive at the target substantially in-phase. The resulting microwave image of the object can be displayed as a two-dimensional (2D) or three-dimensional (3D) image to an operator. Examples of programmable antenna arrays are described in U.S. patent application Ser. Nos. 10/997,422, entitled "A Device for Reflecting Electromagnetic Radiation," and 10/997,583, entitled "Broadband Binary Phased Antenna."

In traditional phased arrays, the custom is to place the antenna elements apart by $\lambda/2$ in both directions to suppress sidelobes throughout a hemispherical scan. The number of antenna elements in a circular area array is about $\pi(D/\lambda)^2$ where D is the diameter of the circle and A is the wavelength of the radiation. The number of antenna elements, and therefore the cost of the array, is proportional to $(D/\lambda)^2$. Each antenna element has traditionally been controlled by its own active device. However, the active devices used in controlling the antenna elements can be expensive, and in some cases may even require one or more stages of amplifiers. Even when the active devices are relatively inexpensive, the system may require a very deep digital memory to support a large set of focal areas or volumes.

One approach for reducing the number of antenna elements is to simply omit elements from the traditional "dense" phased array. The result is known as a "sparse array". While using a sparse array does reduce the number of active devices required, a new problem is created. Sparse arrays are well-known in the ultrasound and microwave/millimeter-wave literature to be associated with grating sidelobes. Sidelobes produce unwanted ghosting phenomena in the scanning or imaging process.

Various remedies have been tried to remove or negate the effect of the sidelobes. For example, deconvolution algorithms can be applied but the most successful of these are nonlinear algorithms which are both scene-dependent and very time-consuming. Two of the most popular deconvolution algorithms are CLEAN and the Maximum Entropy Method or MEM. An older, linear (and hence faster and more general) algorithm is Wiener-Helstrom filtering, but it is well known that it produces inferior image reconstruction compared to nonlinear (slower, more specialized) techniques such as Maximum Likelihood (ML) iteration. Correlation imaging, involving different subsets of an already sparse array, is another nonlinear scheme which tends to be quite slow. In some cases, e.g., radioastronomy, one has prior knowledge about the scene (say, from visible telescopes) which can be used to weed out much of the ghost phenomena. However, this solution is inadequate whenever one is dealing with a highly dynamic environment.

U.S. Application for patent Ser. No. 11/552,193, entitled "Convex Mount for Element Reduction in Phased Arrays with Restricted Scan," which was filed on Oct. 20, 2006, and U.S. Application for patent Ser. No. 11/551,382, entitled "Element Reduction in Phased Arrays with Cladding," which was filed on Oct. 20, 2006, disclose that when the range of solid scan angle is less than $2\pi$ steradians (i.e., less than a hemisphere), it is theoretically possible to reduce the element count without sidelobe degradation. However, U.S. Application for patent Ser. No. 11/552,193 requires that the antenna elements be mounted on a curved surface, and U.S. Application for patent Ser. No. 11/551,382 requires a special material to be applied to the surface of the antenna elements.

Therefore, a need still remains for a reduced-device phased array on a flat surface that does not suffer from sidelobe degradation.

SUMMARY OF THE INVENTION

A plurality of antenna clusters form an antenna array used in microwave imaging. Each antenna cluster has at least two antenna elements and an active device. The active device controls the two antenna elements to direct microwave radiation to and from an object to capture a microwave image of the object.

DETAILED DESCRIPTION

As used herein, the terms microwave radiation and microwave illumination each refer to the band of electromagnetic radiation having wavelengths between 0.3 mm and 30 cm, corresponding to frequencies of about 1 GHz to about 1,000 GHz. Thus, the terms microwave radiation and microwave illumination each include traditional microwave radiation, as well as what is commonly known as millimeter wave radiation. In addition, as used herein, the term "microwave imaging system" refers to an imaging system operating in the microwave frequency range, and the resulting images obtained by the microwave imaging system are referred to herein as "microwave images."

Figure 1:
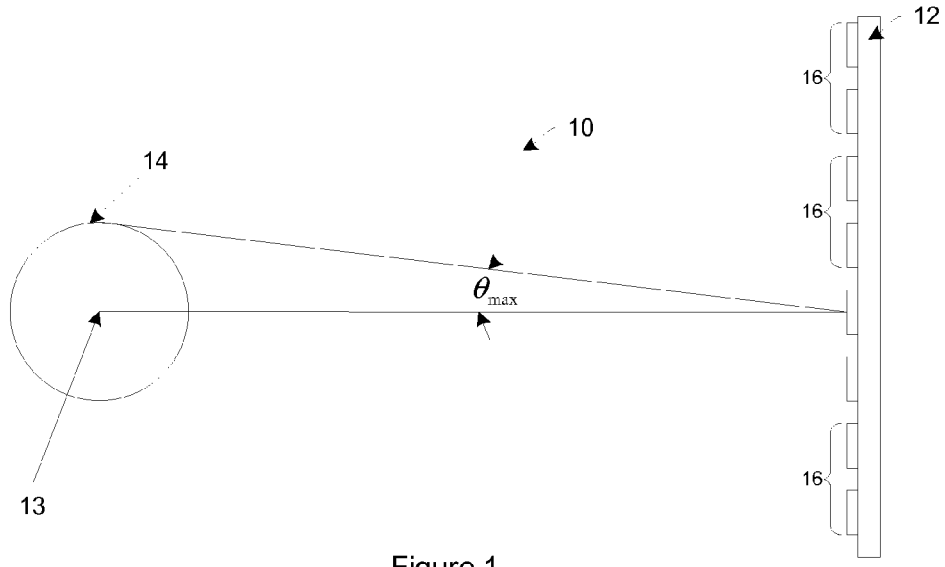
FIG. 1 is a schematic block diagram illustrating an exemplary microwave imaging system, in accordance with embodiments of the present invention.

FIG. 1 is a schematic block diagram of a top view of an exemplary microwave imaging system 10, in accordance with embodiments of the present invention. The microwave imaging system 10 can be used, for example, to provide ongoing surveillance to control a point-of-entry into a structure, monitor passers-by in an area (e.g. a hallway, a room, or outside of a building) or to screen individual persons or other items of interest.

The microwave imaging system 10 includes an antenna array 12 for absorbing or reflecting microwave radiation to scan an object 14. Antenna clusters 16 are formed on the surface of the antenna array. Each antenna cluster 16 is capable of transmitting, receiving, and/or reflecting microwave radiation to capture a microwave image of the object 14. The maximum scan angle $\theta_{max}$ is defined as the maximum required angle of deflection away from the central spot 13 of the object 14 to be scanned. $\theta_{max}$ is limited to less than $\pi/2$ radians (90 degrees) to avoid grating sidelobes. This translates into a solid scan angle of less than a hemisphere ($2\pi$ steradians), which is sufficient for many applications. For example, a security portal for scanning a person only needs a scan angle big enough to scan the person's body size—limiting $\theta_{max}$ to less than 90 degrees is not a problem in this situation.

Figure 2:
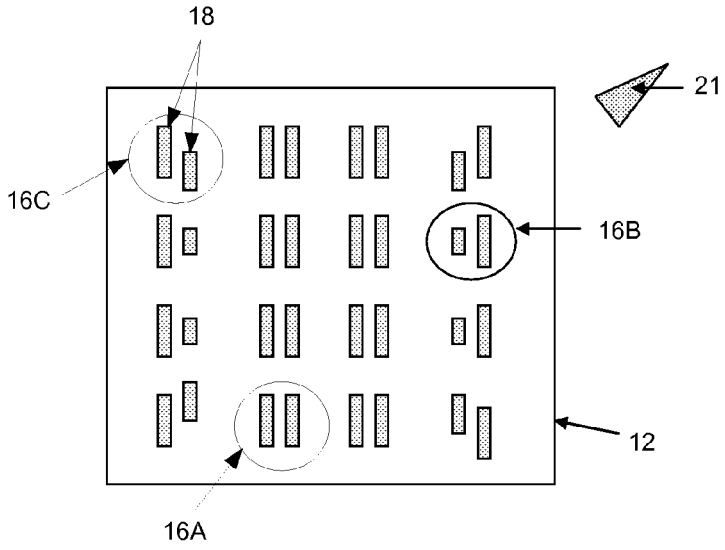
FIG. 2 is a schematic diagram of a front view of an exemplary antenna array for reflecting microwave radiation, in accordance with embodiments of the present invention.

FIG. 2 is a schematic diagram of a front view of an exemplary antenna array 12, in accordance with embodiments of the present invention. Antenna clusters 16A-16C, are symbolic representations of different types of antenna clusters arranged on the surface of the antenna array 12. Each symbol 16A-C could also represent a subarray filled with antenna clusters of that type. Each antenna cluster 16 includes at least two antenna elements 18. All antenna elements 18 within a cluster are controlled by a single active device (not shown). The active device is any switchable device, such as a transistor, diode, micro-electro-mechanical system (MEMS), variable capacitor (such as a barium strontium titanate capacitor), etc. For the sake of simplicity, only 3 cluster types are shown in FIG. 2, but many different types of antenna clusters can be formed.

Each cluster type 16A-16C has a different far-field radiation pattern. Each antenna cluster 16 is capable of transmitting, receiving, and/or reflecting microwave radiation to and from an object to capture a microwave image of the object.

The antenna clusters arranged on an antenna array 12 are chosen so that the resulting combination of radiation patterns provides the desired scan coverage of the object 14. To explain further, each subsection of the antenna array 12 has a quiescent angle to the central spot 13 of the object to be scanned. The antenna array 80 is partitioned so that each local area contains the cluster type whose far-field radiation pattern is optimally matched to the local quiescent angle; that is, when all the active devices are programmed into the same state, the antenna array has a natural bias toward the central spot 13. Although the object may not be in the far field of the entire antenna array, it may still be in the far field of an antenna cluster because the cluster is so much smaller than the entire array. The cumulative effect is that the radiation patterns are directed towards the object. The number and types of antenna clusters needed will depend on various factors such as the size of the object to be scanned, the shape and size of the radiation patterns, etc.

By carefully selecting the desired antenna cluster type(s), an antenna array can be constructed with radiation patterns that are biased towards the center of an object and allow scan coverage of the object. Furthermore, using antenna clusters provides a practical cost savings since a single active device is used to control multiple antenna elements.

In one embodiment, antenna array 12 is a reflectarray, and a feedhorn 21 is used to transmit and receive microwave radiation to and from the antenna clusters 16. The location of the feedhorn 21 should not be in a null or node of any of the antenna clusters. Ideally, the feedhorn 21 should be near an antinode for all of the antenna clusters. Each antenna cluster 16 includes an active device that presents a variable impedance to the antenna elements 18 within each antenna cluster. The variable impedance of the active device in turn controls the reflection amplitude and phase of the antenna cluster 16.

Other modalities may be used to implement antenna array 12, including but not limited to: continuous-phase transmit/receive arrays, transmission (lens) arrays, binary phase arrays, etc.

Figure 3:
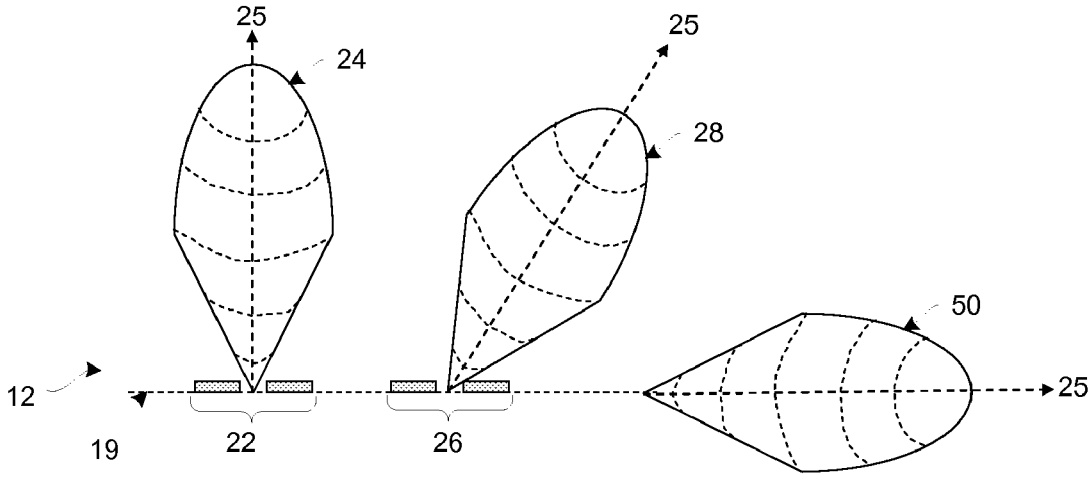
FIG. 3 shows a diagram of a top view of an exemplary antenna array 12 to illustrate exemplary radiation patterns, in accordance with embodiments of the present invention.

FIG. 3 shows a diagram of a side view of an exemplary antenna array 12 to illustrate exemplary radiation patterns, in accordance with embodiments of the present invention. Several radiation patterns are shown relative to an antenna cluster plane 19. A broadside radiation pattern 24, an endfire radiation pattern 50, and an off-axis radiation pattern 28 are illustrated relative to the antenna cluster plane 19. The broadside radiation pattern 24 is a radiation pattern in which the direction of maximum radiation 25 is perpendicular to the antenna cluster plane 19. The endfire radiation pattern 50 is a radiation pattern in which the direction of maximum radiation 25 is in the antenna cluster plane 19. The off-axis radiation pattern is a radiation pattern in which the direction of maximum radiation 25 is at an intermediate angle between a broadside radiation pattern 24 and an endfire radiation pattern 50.

A first antenna cluster 22 has a broadside radiation pattern 24. A second antenna cluster 26 has an off-axis radiation pattern 28. The off-axis radiation pattern 28 may be tilted in the E-plane but centered in the H-plane; tilted in the H-plane but centered in the E-plane, or tilted in both planes depending on the cluster type design. The arrangement and shape of antenna elements within the second antenna cluster 26 determines the off-axis radiation pattern 28 and the degree and direction of its tilt.

FIGS. 4-8 show various possible types of antenna clusters 16 that may be used in an antenna array. FIGS. 4-8 illustrate just a few of the many arrangements of antenna elements and various radiation patterns that are possible.

Figure 4:
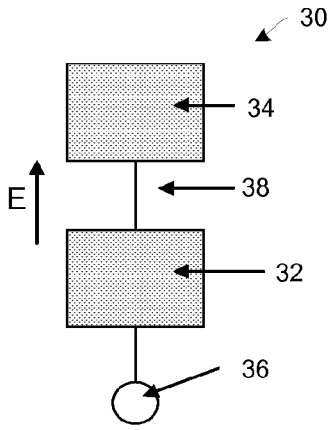
FIGS. 4-8 show various possible types of antenna clusters that may be used in an antenna array, in accordance with embodiments of the present invention.

FIG. 4 shows a schematic diagram of a front view of a broadside E cluster 30, in accordance with embodiments of the present invention. The broadside E cluster 30 includes antenna elements 32, 34, and an active device 36. An arrow E indicates the direction of the electric field vector.

In one embodiment, antenna elements 32 and 34 are planar patch antennas that reflect microwave radiation to and from a microwave transmitter/receiver, such as a feedhorn. The impedance of the active device 36 is varied to control the reflection phase of the antenna element 32. The antenna element 32 is connected in series to antenna element 34 by a delay line 38. The length of the delay line 38 is chosen so that the antenna element 34 will be excited in-phase with the antenna element 32 when fed by the active device 36. Taking into account the half-wave length of antenna element 32, the delay line 38 is a 180° degree delay line. Since antenna elements 32 and 34 are excited in-phase, this antenna cluster has a broadside radiation pattern 24 in the E-plane. The size and shape of the radiation pattern can be adjusted by adjusting various parameters such as the size and shape of the antenna elements 32 and 34, Additional antenna elements can be added to this cluster using additional 180° degree delay lines.

Figure 5:
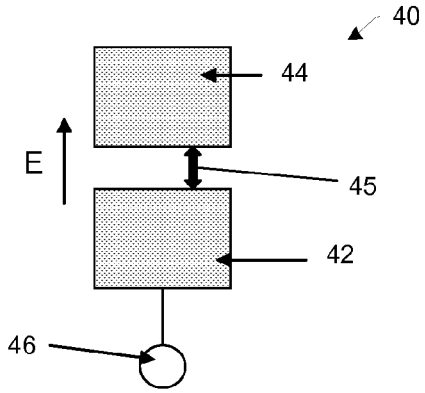

FIG. 5 shows a schematic diagram of a top view of an off-axis E cluster 40, in accordance with embodiments of the present invention. The antenna cluster includes a master antenna element 42, a slave antenna element 44, and an active device 46. An arrow E indicates the direction of the electric field vector. In one embodiment, master antenna element 42 and slave antenna element 44 are planar patch antennas that reflect microwave radiation to and from a microwave transmitter/receiver, such as a feedhorn. The impedance of the active device 46 is varied to control the reflection phase of the master antenna element 42. The active device 46 directly feeds master antenna element 42. Slave antenna element 44 is parasitically coupled (as indicated by arrow 45) to master antenna element 42 in the E-plane direction—no actual physical connection between the antenna elements exists.

Due to their parasitic coupling, master antenna element 42 and slave antenna element 44 are excited out-of-phase, and therefore have an off-axis radiation pattern 28. The tilt degree and direction of the radiation pattern 28 are determined by the strength of the parasitic coupling 45, the size and shape of the slave antenna element 44 relative to the master antenna element 42, and the position of the slave antenna element 44 relative to the master antenna element 42. Although only a single slave antenna element is shown, additional slave antenna elements can be included to couple parasitically with the master antenna element 42.

Figure 6:
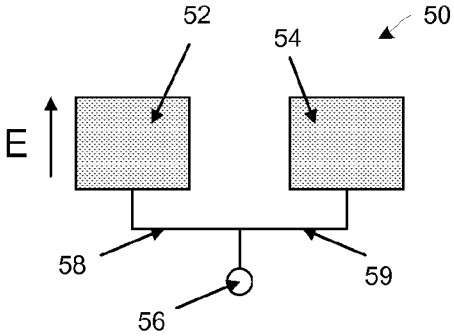

FIG. 6 shows a schematic diagram of a front view of a broadside H cluster 50, in accordance with embodiments of the present invention. The broadside H cluster 50 includes antenna elements 52, 54, and an active device 56. An arrow E indicates the direction of the electric field vector. In one embodiment, antenna elements 52 and 54 are planar patch antennas that reflect microwave radiation to and from a microwave transmitter/receiver, such as a feedhorn. The impedance of the active device 56 is varied to control the reflection phase of the antenna elements 52 and 54. The active device 56 is connected to antenna element 52 by a transmission line 58. The active device 56 is connected to antenna element 54 by a transmission line 59. Both transmission lines 58 and 59 are of equal length, so the antenna elements 52 and 54 are excited in phase. As a result, this antenna cluster has a broadside radiation pattern 24.

Figure 7:
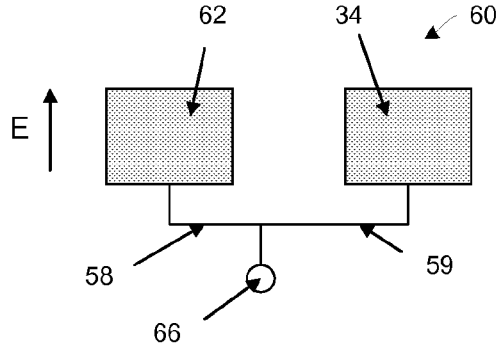

FIG. 7 shows a schematic diagram of a front view of an off-axis H cluster 60, in accordance with embodiments of the present invention. The off-axis H cluster 60 includes antenna elements 62, 64, and an active device 66. An arrow E indicates the direction of the electric field vector. In one embodiment, antenna elements 62 and 64 are planar patch antennas that reflect microwave radiation to and from a microwave transmitter/receiver, such as a feedhorn. The impedance of the active device 66 is varied to control the reflection phase of the antenna element 62. The active device 66 is connected to antenna element 62 by a transmission line 58. The active device 66 is also connected to antenna element 64 by a transmission line 59. Transmission line 58 is of a different length than transmission line 59. As a result, the antenna elements are excited out-of-phase and produce an off-axis radiation pattern 28 that is tilted in the H-plane. The tilt degree and direction of the radiation pattern 28 are determined by the difference in lengths of transmission lines 58 and 59.

Both the antenna impedance of the cluster and the antenna amplitude balance within the cluster are functions of the phase offset. This is not an issue for the antenna clusters that are excited in-phase. However, it is a concern with respect to antenna clusters having out-of-phase excitations, especially with the topology of off-axis H cluster 60 in FIG. 7. As a result, the lengths and widths of transmission lines 58 and 59, as well as the characteristics of antenna elements 62 and 64, must be determined carefully to achieve amplitude balance within the cluster and to present the optimal antenna impedance to the active device 66.

Figure 8:
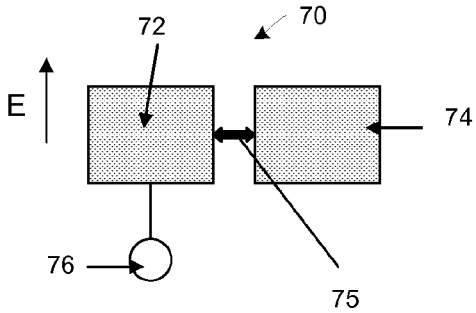

FIG. 8 shows a schematic diagram of a front view of an off-axis H cluster 70, in accordance with embodiments of the present invention. The off-axis H cluster 70 includes master antenna element 72, slave antenna element 74, and an active device 76. An arrow E indicates the direction of the electric field vector. In one embodiment, master antenna element 72 and slave antenna element 74 are planar patch antennas that reflect microwave radiation to and from a microwave transmitter/receiver, such as a feedhorn. The impedance of the active device 76 is varied to control the reflection phase of the master antenna element 72. The active device 76 directly feeds master antenna element 72. Slave antenna element 74 is parasitically coupled (as indicated by arrow 75) to master antenna element 72 in the H-plane direction—no actual physical connection between the antenna elements exists.

As a result of the parasitic coupling, slave antenna element 74 is excited out-of-phase with master antenna element 72. As a result, an off-axis radiation pattern 28 that is tilted in the H-plane is produced. The tilt degree and direction of the radiation pattern 28 are determined by the strength of the parasitic coupling, the size and shape of the slave antenna element 74 relative to the master antenna element 72, and the position of the slave antenna element 74 relative to the master antenna element 72. Although only a single slave antenna element is shown, additional slave antenna elements can be included to couple parasitically with the master antenna element 72.

The off-axis H-cluster 70 is an alternative to the off-axis H-cluster of FIG. 7. Since the coupling of antenna elements 72 and 74 is achieved parasitically, it is unnecessary to worry about the impedances of the feed transmission lines.

In all of the above examples of antenna clusters in FIGS. 4-8, the antenna elements are represented as planar patch antennas, but other types of antennas can be used. Example antenna types that can be used as antenna elements in the antenna clusters include, but are not limited to: dipoles, monopoles, slot antennas, loop antennas, open waveguides, horns, etc. Furthermore, FIGS. 4-8 represent the planar patch antennas as passive elements that reflect microwave radiation to and from a microwave transmitter/receiver (such as a feedhorn) —however, active antenna elements that actively transmit and receive microwave radiation may also be used.

In addition, although only 2 antenna elements are shown in the figures, it should be apparent to one of ordinary skill in the art that each antenna cluster can easily be modified to include more than 2 antenna elements. Furthermore, the active device in each of the clusters can be any switchable device, such as a transistor, diode, micro-electro-mechanical system (MEMS), variable capacitor (such as a barium strontium titanate capacitor), etc. Finally, the degree and direction of tilt for the radiation pattern of any antenna cluster can be changed by varying parameters such as the size, shape, and location of the antenna elements within the cluster.

Figure 9:
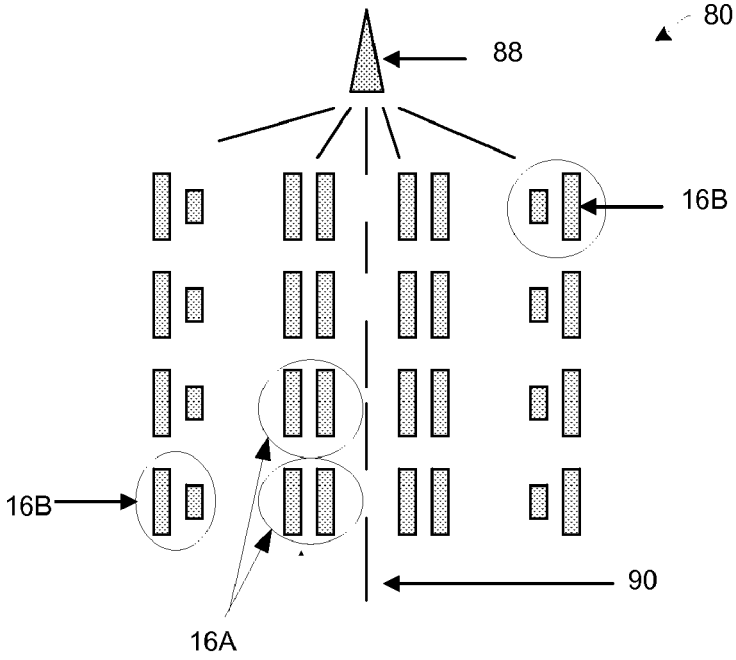
FIG. 9 shows one embodiment of an antenna array, in accordance with embodiments of the present invention.

FIG. 9 shows one embodiment of an antenna array 80 according to the present invention. Antenna array 80 is a reflectarray with two types of antenna clusters: antenna clusters 16A and 16B. The antenna clusters are arranged symmetrically across a vertical symmetry plane 90 that bisects the antenna array 80. A feedhorn 88 transmits and receives microwave radiation to and from all the antenna clusters. The feedhorn 88 is situated in the symmetry plane 90, either above or below the object to be scanned.

Each antenna cluster 16A has a broadside radiation pattern. Suitable antenna clusters include the broadside E cluster 30 of FIG. 4, and the broadside H cluster 50 of FIG. 6. The broadside antenna clusters 16A are installed close to the symmetry plane 90 and have the same function regardless of whether the physical layout is mirrored or not, since antenna clusters 16A have a broadside radiation pattern that is symmetrical.

The antenna clusters 16B are installed further from the symmetry plane 90. Each antenna cluster 16B has an off-axis radiation pattern in the horizontal direction. Suitable antenna clusters are the off-axis E cluster 40 of FIG. 5, and the off-axis H clusters 60 and 70 of FIGS. 5 and 6, respectively. Care must be taken to install these antenna clusters with the right orientation. Since antenna clusters 16B have off-axis radiation patterns, the radiation patterns will point away from the object if the antenna clusters 16B are installed incorrectly. Notice in FIG. 9 that the antenna clusters 16B on the left side of antenna array 80 are the mirror image (across the symmetry plane 90) of the antenna clusters 16B on the right side of antenna array 80.

Preferably, both antenna clusters 16A and 16B have neutral (quasi-isotropic) radiation patterns with respect to the vertical direction. The feedhorn 88 is rotated to match the polarization of the antenna clusters. For example, in FIG. 9, the feedhorn 88 would be rotated if all antenna clusters were rotated.

The antenna clusters 16A have broadside radiation patterns and are located centrally, close to the symmetry plane 90. The antenna clusters 16B have off-axis radiation patterns and are located along the further edges of the antenna array 80. However, the radiation patterns of the antenna clusters 16B are selected to tilt back toward the symmetry plane 90. As a result, a centrally located object can be scanned with high efficiency. For optical scan coverage, the object should straddle or be near the symmetry plane 90 such that its central spot lies on the symmetry plane.

More than two types of antenna clusters may be used in building an antenna array. For example, antenna clusters that have off-axis radiation patterns in the vertical direction may be added as top and bottom rows to the antenna array in FIG. 9. Another option is to use only a single type of antenna cluster to build the antenna array.

Although antenna array 80 is depicted in FIG. 9 as a reflectarray, and the antenna clusters shown reflect microwave radiation to and from the feedhorn 88, other kinds of antenna arrays may also be used. For example, the antenna clusters may also consist of active transmitting and receiving antenna elements, in which case a feedhorn 88 is unnecessary.

Although the present invention has been described in detail with reference to particular embodiments, persons possessing ordinary skill in the art to which this invention pertains will appreciate that various modifications and enhancements may be made without departing from the spirit and scope of the claims that follow.

What is claimed is:

1. An apparatus for microwave imaging, comprising:

a plurality of antenna clusters forming an antenna array, each antenna cluster comprising: at least two antenna elements; and an active device controlling the at least two antenna elements to direct microwave radiation to and from an object to capture a microwave image of the object, the plurality of antenna clusters further comprising: a first antenna cluster type with a first radiation pattern and a second antenna cluster type with a second radiation pattern having a different angle of tilt than the first radiation pattern.

2. An apparatus as in claim 1, wherein the first antenna cluster type has a broadside radiation pattern, and the second antenna cluster type has an off-axis radiation pattern.

3. An apparatus as in claim 2, wherein the first and second antenna cluster types are arranged symmetrically about a plane passing through the antenna array.

4. An apparatus as in claim 3, wherein the first antenna cluster type is located closer to the plane than the second antenna cluster type, and wherein the off-axis radiation pattern of the second antenna cluster type is tilted towards the object.

5. An apparatus as in claim 2, wherein the first antenna cluster type further comprises: a first antenna element; a second antenna element excited in-phase with the first antenna element; and a first active device coupled to the first antenna element.

6. An apparatus as in claim 5, wherein the second antenna element is coupled to the first antenna element by a first transmission line, the first transmission line having a length that inserts a 180° delay between the first and second antenna elements.

7. An apparatus as in claim 6, wherein the first active device controls the first antenna element by varying the impedance presented to the first antenna element.

8. An apparatus as in claim 2, wherein the second antenna cluster type further comprises: a master antenna element; a slave antenna element excited out-of-phase with the master antenna element; and a second active device coupled to the master antenna element.

9. An apparatus as in claim 8, wherein the slave antenna element is parasitically coupled to the master antenna element.

10. An apparatus as in claim 9, wherein the second active device controls the master antenna element by varying the impedance presented to the master antenna element.

11. An apparatus as in claim 1, wherein the antenna array scans a solid angle less than $2\pi$ steradians.

12. An apparatus as in claim 1, wherein the plurality of antenna clusters are formed on a planar surface.

13. An apparatus as in claim 1, wherein the at least two antenna elements are selected from the group consisting of planar patch antennas, dipoles, monopoles, slot antennas, loop antennas, open waveguides, and horns.

14. An apparatus as in claim 1, further comprising a feed-horn that transmits and receives microwave radiation, wherein the active device controls the at least two antenna elements to reflect the microwave radiation to and from the object by varying the reflection phase of the two antenna elements.

15. An apparatus as in claim 1, wherein the active device is selected from the group consisting of transistors, diodes, micro-electro-mechanical systems (MEMS), and variable capacitors.

16. An apparatus for microwave imaging, comprising:

a plurality of antenna clusters forming an antenna array, each antenna cluster comprising: at least two antenna elements operated in unison to direct microwave radiation to and from an object to capture a microwave image of the object, wherein the plurality of antenna clusters further comprises a first antenna cluster type with a first radiation pattern and a second antenna cluster type with a second radiation pattern having a different angle of tilt than the first radiation pattern.

* * * * *